US010267150B2

(12) United States Patent
Maruyama

(10) Patent No.: US 10,267,150 B2
(45) Date of Patent: Apr. 23, 2019

(54) VANE UNIT AND STEAM TURBINE

(71) Applicant: MITSUBISHI HITACHI POWER SYSTEMS, LTD., Kanagawa (JP)

(72) Inventor: Takashi Maruyama, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 357 days.

(21) Appl. No.: 15/318,782

(22) PCT Filed: Jun. 9, 2015

(86) PCT No.: PCT/JP2015/066617
§ 371 (c)(1),
(2) Date: Dec. 14, 2016

(87) PCT Pub. No.: WO2015/198853
PCT Pub. Date: Dec. 30, 2015

(65) Prior Publication Data

US 2017/0130584 A1 May 11, 2017

(30) Foreign Application Priority Data

Jun. 27, 2014 (JP) ..... 2014-133260

(51) Int. Cl.
*F01D 1/04* (2006.01)
*F01D 5/02* (2006.01)
(Continued)

(52) U.S. Cl.
CPC ..... *F01D 1/04* (2013.01); *F01D 5/02* (2013.01); *F01D 9/041* (2013.01); *F01D 9/065* (2013.01);
(Continued)

(58) Field of Classification Search
CPC ... F01D 1/04; F01D 5/02; F01D 9/041; F01D 9/065; F01D 25/24; F05D 2220/31; F05D 2250/184
See application file for complete search history.

(56) References Cited

U.S. PATENT DOCUMENTS 4,721,433 A * 1/1988 Piendel ..... F01D 25/14 415/115
5,743,708 A * 4/1998 Cunha ..... F01D 5/187 415/115
(Continued)

FOREIGN PATENT DOCUMENTS

JP 55-73501 5/1980
JP 1-300002 12/1989
(Continued)

OTHER PUBLICATIONS

International Search Report dated Aug. 25, 2015 in International (PCT) Application No. PCT/JP2015/066617.
(Continued)

*Primary Examiner* — Igor Kershteyn
(74) *Attorney, Agent, or Firm* — Wenderoth, Lind & Ponack, L.L.P.

(57) ABSTRACT

Provided are a vane unit and a steam turbine. A vane unit in which an outer ring and an inner ring are connected by a plurality of vanes arranged at predetermined intervals in a circumferential direction is provided with: a steam outer ring inlet portion provided in a first heating chamber of the outer ring; a steam outer ring outlet portion provided in the first heating chamber of the outer ring so as to be separated from the steam outer ring inlet portion in the circumferential direction; and a first steam passage that makes the steam outer ring inlet portion and the steam outer ring outlet portion communicate with each other in the first heating chamber of the outer ring. Thus, steam is efficiently used,
(Continued)

and erosion due to wet steam is suppressed and a decrease in thermal efficiency is suppressed.

12 Claims, 6 Drawing Sheets

(51) Int. Cl.

| | |
|---|---|
| ***F01D 9/04*** | (2006.01) |
| ***F01D 25/24*** | (2006.01) |
| ***F01D 9/06*** | (2006.01) |
| ***F01D 25/10*** | (2006.01) |
| *F01D 25/32* | (2006.01) |

(52) U.S. Cl.
CPC ..... *F01D 25/10* (2013.01); *F01D 25/24* (2013.01); *F01D 25/32* (2013.01); *F05D 2220/31* (2013.01); *F05D 2250/184* (2013.01)

(56) References Cited

U.S. PATENT DOCUMENTS 6,135,711 A * 10/2000 Binder ..... F01D 5/147 415/209.3
2002/0150467 A1* 10/2002 Tanioka ..... F01D 11/24 415/115
2011/0171005 A1* 7/2011 Ito ..... F01D 5/081 415/115
2014/0020359 A1* 1/2014 Mimura ..... F01D 9/065 60/39.182
2014/0020391 A1* 1/2014 Onoda ..... F01D 9/041 60/730
2014/0020402 A1* 1/2014 Okamura ..... F01D 25/12 60/784

FOREIGN PATENT DOCUMENTS

| | | |
|---|---|---|
| JP | 3-294603 | 12/1991 |
| JP | 8-158810 | 6/1996 |
| JP | 10-103008 | 4/1998 |
| JP | 2012-140901 | 7/2012 |
| JP | 2013-148039 | 8/2013 |

OTHER PUBLICATIONS

Written Opinion of the International Searching Authority dated Aug. 25, 2015 in corresponding (PCT) International Application No. PCT/JP2015/066617.

* cited by examiner

VANE UNIT AND STEAM TURBINE

FIELD

The present invention relates to a vane unit in which an outer ring and an inner ring are connected by a plurality of vanes arranged at predetermined intervals in a circumferential direction, and to a steam turbine which includes a plurality of vanes and a plurality of blades, and which drives and rotates a rotor using steam.

BACKGROUND

A typical steam turbine is configured such that a rotor as a rotating shaft is rotatably supported by a casing, and that blades are provided on an outer circumferential portion of the rotor and vanes are provided in the casing so that the blades and the vanes are alternately arranged in a plurality of stages in a steam passage. Therefore, when steam flows in the steam passage, the flow of the steam is straightened by the vanes, so that the steam can drive and rotate the rotor through the blades.

In such a steam turbine, in a final stage of a cascade of a low-pressure turbine, the steam becomes wet steam mixed with water drops (drain). Therefore, a loss due to the wet steam occurs. Further, the water drops contained in the wet steam collide with the blades rotating at a high speed, so that erosion occurs in end portions of the blades.

To solve such a problem, a technology of heating vanes and an outer ring and an inner ring that support the end portions of the vanes is described in Patent Literatures below. In steam turbines described in Patent Literatures, steam is supplied to a hollow portion of the outer ring, supplied to a hollow portion of the inner ring through hollow portions of a plurality of vanes, returned to the hollow portion of the outer ring through the hollow portions of the plurality of vanes again, and then discharged. The vanes, the outer ring, and the inner ring are heated by the steam.

CITATION LIST

Patent Literature

Patent Literature 1: Japanese Laid-open Patent Publication No. 2013-148039

Patent Literature 2: Japanese Laid-open Patent Publication No. 10-103008

SUMMARY

Technical Problem

In the steam turbines described in Patent Literatures, the steam is brought to circulate in the hollow portion of the outer ring, the hollow portions of the vanes, and the hollow portion of the inner ring, thereby to heat the outer ring, the vanes, and the inner ring. By the way, to prevent the erosion due to wet steam, it is not necessary to heat all regions of the outer ring, the vanes, and the inner ring, and an effect to suppress the erosion can be sufficiently exhibited only by heating a region where the erosion is more likely to occur. Meanwhile, the steam used for heating is bled from a boiler or the steam turbine, and use of a large amount of the steam causes a loss of energy and incurs a decrease in thermal efficiency.

The present invention solves the above problems, and an objective is to provide a vane unit and a steam turbine that suppress erosion due to wet steam and suppress a decrease in thermal efficiency by efficiently using the steam.

Solution to Problem

According to an aspect of the present invention, a vane unit in which an outer ring and an inner ring are connected by a plurality of vanes arranged at predetermined intervals in a circumferential direction, comprises: a steam outer ring inlet portion provided in a cavity portion of the outer ring; a steam outer ring outlet portion provided in the cavity portion of the outer ring so as to be separated from the steam outer ring inlet portion in the circumferential direction; and a first steam passage making the steam outer ring inlet portion and the steam outer ring outlet portion communicate with each other in the cavity portion of the outer ring.

Therefore, the steam outer ring inlet portion and the steam outer ring outlet portion are provided in the cavity portion of the outer ring so as to be separated from each other in the circumferential direction, and the steam outer ring inlet portion and the steam outer ring outlet portion communicate with each other by the first steam passage, so that the steam supplied to the steam outer ring inlet portion passes through the first steam passage in the cavity portion of the outer ring, and is discharged through the steam outer ring outlet portion. Therefore, since the steam passes through the first steam passage instead of the cavity portion of the outer ring, only necessary portions of the outer ring and the vanes are heated with a small amount of steam, and thus an amount of use of the steam is decreased and the small amount of steam is efficiently used, whereby erosion due to wet steam can be appropriately suppressed.

Advantageously, in the vane unit, the first steam passage is arranged along an inner circumferential side in the cavity portion of the outer ring.

Therefore, the first steam passage is arranged along the inner circumferential side in the cavity portion of the outer ring, so that the inner circumferential side of the outer ring, that is, end portions of the vanes on the outer ring side in the vane unit are heated by the steam, and the portions, to which drain water is more likely to adhere, can be efficiently heated.

Advantageously, in the vane unit, the first steam passage is formed by a tube.

Therefore, the first steam passage is formed by a tube, so that the first steam passage can be easily arranged in the cavity portion of the outer ring, and manufacturing cost can be decreased.

Advantageously, in the vane unit, the steam outer ring inlet portion includes an outer ring inlet header formed by partitioning a part of the cavity portion by a pair of inlet partition plates, and a steam supply port provided in the outer ring and communicating with the outer ring inlet header; and the steam outer ring outlet portion includes an outer ring outlet header formed by partitioning a part of the cavity portion by a pair of outlet partition plates, and a steam discharge port provided in the outer ring and communicating with the outer ring outlet header.

Therefore, the outer ring inlet header partitioned by the inlet partition plates is provided as the steam outer ring inlet portion, and the outer ring outlet header partitioned by the outlet partition plates is provided as the steam outer ring outlet portion, so that the steam from an outside can be easily supplied to the steam outer ring inlet portion, and the steam can be easily discharged through the steam outer ring outlet portion. Further, end portions of the first steam passage can be easily connected with the steam outer ring inlet portion and the steam outer ring outlet portion.

Advantageously, in the vane unit, drain discharge portions are provided adjacent to the outer ring inlet header and the outer ring outlet header in the cavity portion of the outer ring, and the drain discharge portions communicate with hollow portions of the vanes.

Therefore, the drain discharge portions provided in the cavity portion of the outer ring, adjacent to the outer ring inlet header and the outer ring outlet header, communicate with the hollow portions of the vanes, so that the drain entering the hollow portions of the vanes can be easily discharged through the drain discharge portions.

Advantageously, the vane unit further comprises: a steam inner ring inlet portion provided in a cavity portion of the inner ring; a steam inner ring outlet portion provided in the cavity portion of the inner ring so as to be separated from the steam inner ring inlet portion in the circumferential direction; an inlet communication passage provided in the vane and making the steam outer ring inlet portion and the steam inner ring inlet portion communicate with each other; an outlet communication passage provided in the vane and making the steam outer ring outlet portion and the steam inner ring outlet portion communicate with each other; and a second steam passage making the steam inner ring inlet portion and the steam inner ring outlet portion communicate with each other in the cavity portion of the inner ring.

Therefore, the steam inner ring inlet portion and the steam inner ring outlet portion are provided in the cavity portion of the inner ring so as to be separated from each other in the circumferential direction; the steam outer ring inlet, portion and the steam inner ring inlet portion communicate with each other by the inlet communication passage of the vane; the steam outer ring outlet portion and the steam inner ring outlet portion communicate with each other by the outlet communication passage of the vane; and the steam inner ring inlet portion and the steam inner ring outlet portion communicate with each other by the second steam passage. The steam supplied to the steam outer ring inlet portion flows through the inlet communication passage to the steam inner ring inlet portion, passes through the second steam passage in the cavity portion of the inner ring, flows into the steam inner ring outlet portion, and is discharged from the steam outer ring outlet portion through the outlet communication passage. Therefore, since the steam passes through the second steam passage, instead of the cavity portion of the inner ring, only necessary portions of the inner ring and the vanes are heated with a small amount of steam, and thus an amount of use of the steam is decreased and the small amount of steam is efficiently used, whereby erosion due to wet steam can be appropriately suppressed.

Advantageously, in the vane unit, the second steam passage is disposed along an outer circumferential side in the cavity portion of the inner ring.

Therefore, the second steam passage is disposed along the outer circumferential side in the cavity portion of the inner ring, so that, the outer circumferential side of the inner ring, that is, end portions of the vanes on the inner ring side in the vane unit are heated by the steam, and the portions, to which drain is more likely to adhere, can be efficiently heated.

Advantageously, in the vane unit, the second steam passage is formed by a tube.

Therefore, the second steam passage is formed by a tube, so that the second steam passage can be easily arranged in the cavity portion of the inner ring, and the manufacturing cost can be decreased.

According to another aspect of the present invention, a steam turbine comprises: a casing; a rotor rotatably supported inside the casing; a plurality of stages of blade units each having a plurality of blades arranged at predetermined intervals in a circumferential direction of the rotor, with base end portions of the blades supported by the rotor; and a plurality of stages of vane units each having a plurality of vanes arranged at predetermined intervals in the circumferential direction of the rotor, with base end portions and tip end portions of the vanes supported by the casing. The vane unit according to any one of the above is applied as the vane unit of a final stage of the plurality of stages of the vane units.

Therefore, in the vane unit of the final stage, since the steam passes through the steam passage instead of the cavity portion of the outer ring, only necessary portions of the outer ring, the inner ring, and the vanes are heated with a small amount of steam, and thus an amount of use of the steam is decreased and the small amount of steam is efficiently used, whereby erosion due to wet steam can be appropriately suppressed, and thermal efficiency of the steam turbine can be improved.

Advantageous Effects of Invention

According to the vane unit and the steam turbine of the present invention, the steam outer ring inlet portion and the steam outer ring outlet portion are provided in the cavity portion of the outer ring so as to be separated from each other in the circumferential direction, and the steam outer ring inlet portion and the steam outer ring outlet portion communicate with each other by the first steam passage. Therefore, the amount of use of the steam is decreased and the small amount of steam is efficiently used, whereby erosion due to wet steam can be appropriately suppressed.

DESCRIPTION OF EMBODIMENTS

Hereinafter, a favorable embodiment of a vane unit and a steam turbine according to the present invention will be described in detail with reference to the appended drawings. Note that the present invention is not limited by the embodiment, and in a case where there is a plurality of embodiments, the present invention also includes configurations of combinations of the embodiments.

Figure 8:
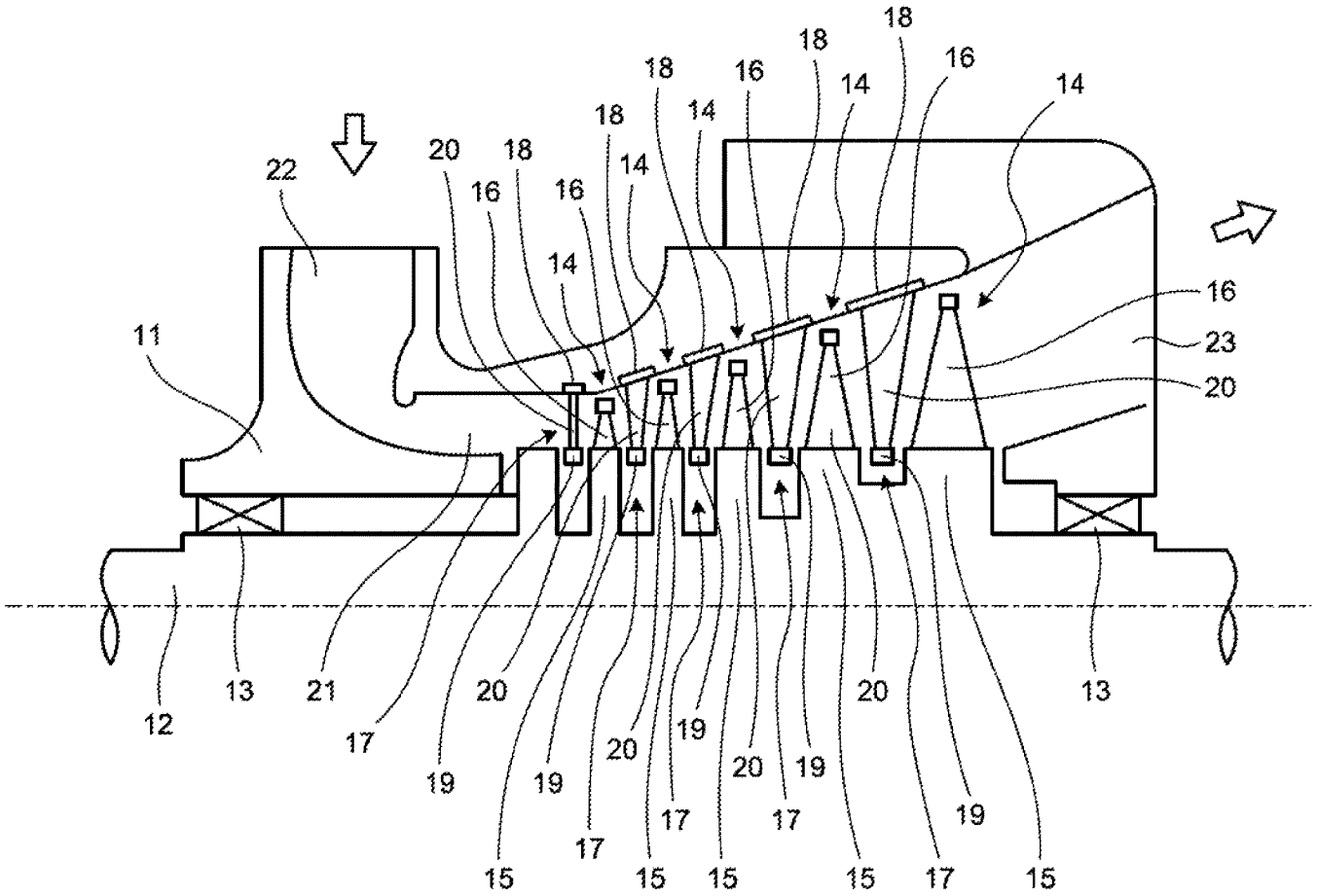
FIG. 8 is a schematic configuration view illustrating a steam turbine of the present embodiment.

FIG. 8 is a schematic configuration view of a steam turbine of the present embodiment.

In the steam turbine, as illustrated in FIG. 8, a casing 11 has a hollow shape, and a rotor 12 is rotatably supported by a plurality of bearings 13. This rotor 12 is provided with a plurality of blade units 14 on an outer circumferential portion at predetermined intervals in an axial direction, inside the casing 11. The blade units 14 are composed of a plurality of disks 15 provided on the outer circumferential portion of the rotor 12 at predetermined intervals in the axial direction, and a plurality of blades 16 fixed to outer circumferential portions of the disks 15 along a circumferential direction.

Further, the casing 11 is provided with a plurality of vane units 17 therein at predetermined intervals in the axial direction of the rotor 12. The vane units 17 are composed of a plurality of outer rings 18 and inner rings 19 arranged on the outer circumferential portion of the rotor 12 at predetermined intervals in the axial direction, and a plurality of vanes 20 fixed along the circumferential direction to connect the outer rings 18 and the inner rings 19. As described above, the blade units 14 and the vane units 17 are alternately arranged in the axial direction of the rotor 12.

Further, in the casing 11, a steam passage 21 is formed in a passage in which the plurality of blade units 14 and the plurality of vane units 17 are arranged. Then, the casing 11 is provided with a steam supply port 22 and a steam discharge port 23 communicating with the steam passage 21.

Therefore, when steam is supplied through the steam supply port 22 into the steam passage 21, the steam can drive and rotate the rotor 12 through the blade units 14 by passing through the plurality of blade units 14 and vane units 17. The rotor 12 is connected with a generator (not illustrated), and can drive the generator to generate electricity.

By the way, in a final stage of the cascade of a low-pressure turbine, steam becomes wet steam containing drain. Much of the drain collides with and adheres to end portions of the vanes 20 on an outer ring 18 side (hereinafter, the end portions are referred to as outer ring-side end portions) and end portions of the vanes 20 on an inner ring 19 side (hereinafter, the end portions are referred to as inner ring-side end portions), and the drain scattering from there collides with the blades 16 rotating at a high speed, so that erosion occurs.

Therefore, in the present embodiment, the steam is brought to flow in the outer rings 18, the inner rings 19, and the vanes 20 that compose the vane units 17, and heats only necessary portions of the outer rings 18, the inner rings 19, and the vanes 20, so that the erosion by the wet steam is suppressed.

Figure 1:
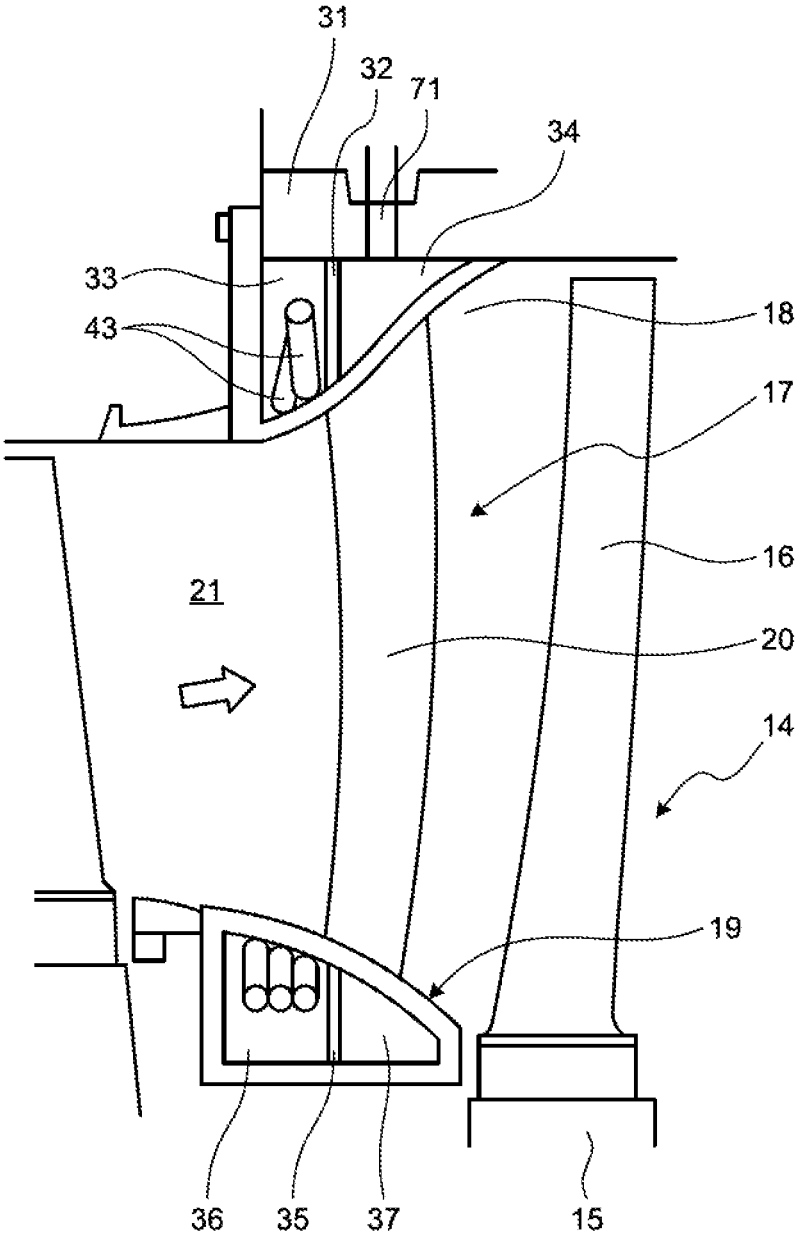
FIG. 1 is a schematic view illustrating a vane unit in a steam turbine of an embodiment.
Figure 2:
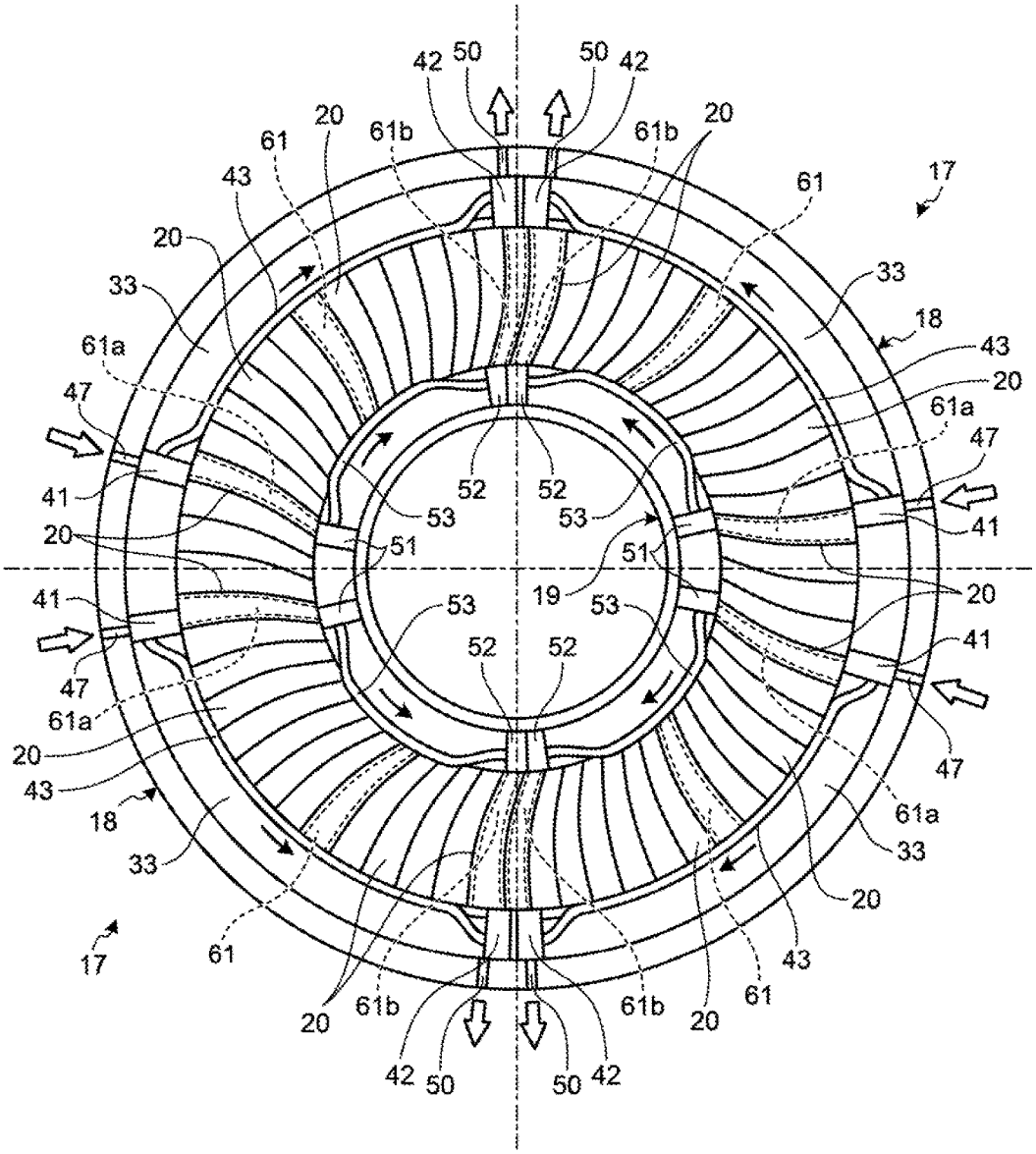
FIG. 2 is a front view of the vane unit.
Figure 3:
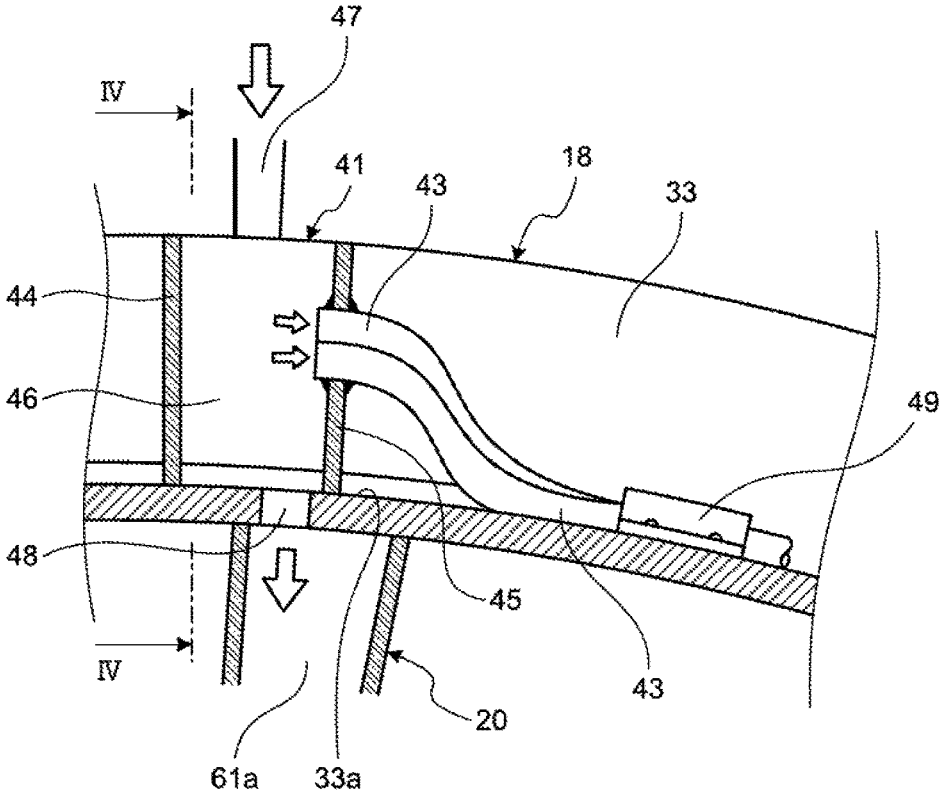
FIG. 3 is a section view of a steam inlet portion in an outer ring.
Figure 4:
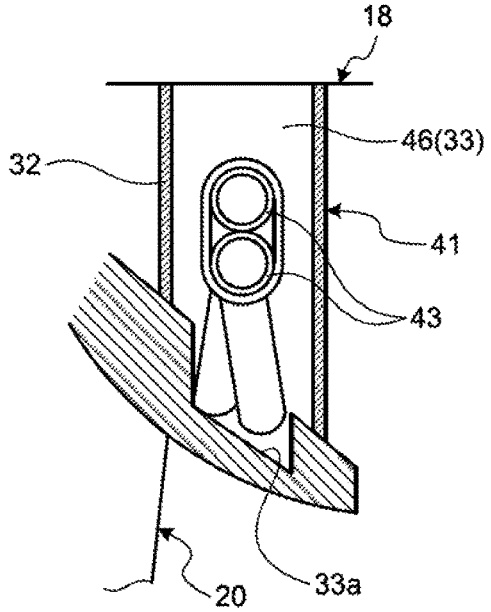
FIG. 4 is a IV-IV section view of FIG. 3.
Figure 5:
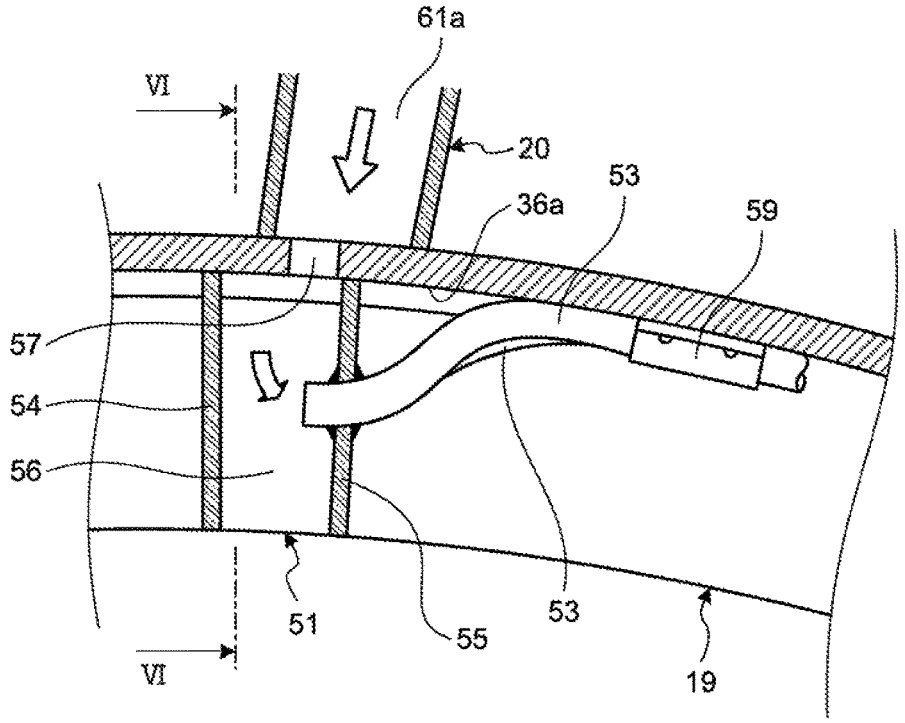
FIG. 5 is a section view of a steam inlet portion in an inner ring.
Figure 6:
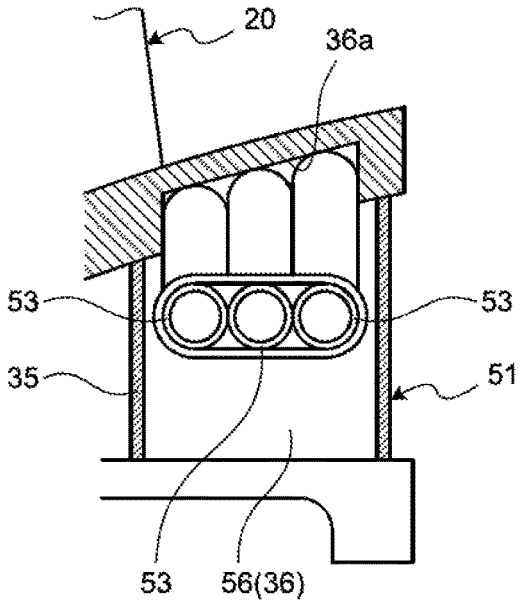
FIG. 6 is a VI-VI section view of FIG. 5.
Figure 7:
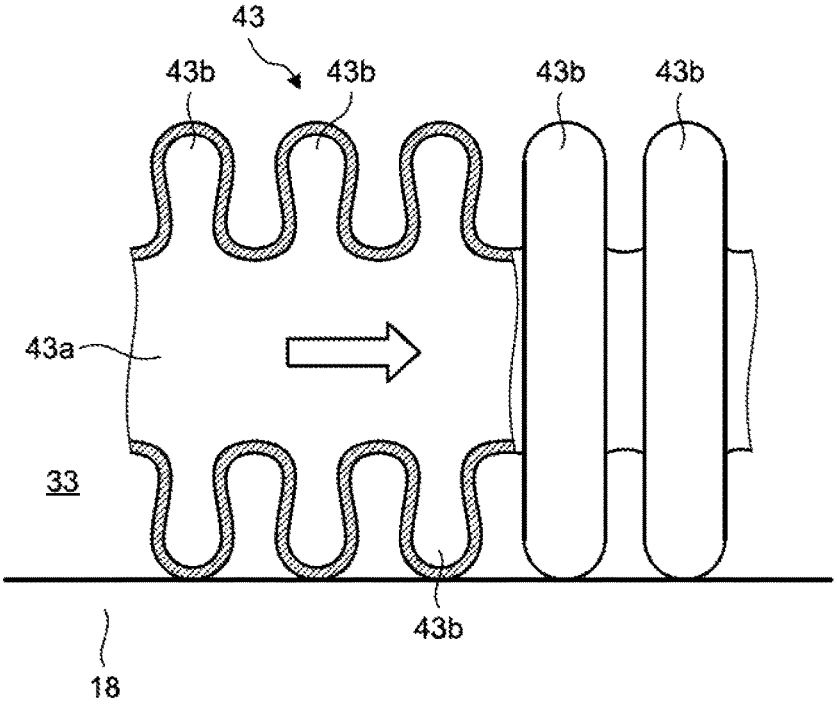
FIG. 7 is a section view of a tube.

FIG. 1 is a schematic view illustrating a vane unit in a steam turbine of the present embodiment. FIG. 2 is a front view of the vane unit, FIG. 3 is a section view of a steam inlet portion in an outer ring, FIG. 4 is a IV-IV section view of FIG. 3, FIG. 5 is a section view of a steam inlet portion in an inner ring, FIG. 6 is a VI-VI section view of FIG. 5, and FIG. 7 is a section view of a tube.

As illustrated in FIGS. 1 and 2, the vane unit 17 in the final stage is configured such that the outer ring (ring segment) 18 and the inner ring (shroud) 19 are connected by the plurality of vanes 20 arranged at predetermined intervals in the circumferential direction. The outer ring 18 is formed into a ring shape, and an outer circumferential portion of the outer ring 18 is fixed to a frame 31 of the casing 11 (see FIG. 8), so that the outer ring 18 has a cylindrical sectional shape. In the outer ring 18, a partition wall 32 along the circumferential direction is fixed inside the outer ring 18, so that a first heating chamber (cavity portion) 33 and a first drain discharge chamber (drain discharge portion) 34 are partitioned and formed.

Meanwhile, the inner ring 19 is formed into a ring shape with a smaller diameter than the outer ring 18, and has a cylindrical sectional shape. In the inner ring 19, a partition wall 35 along the circumferential direction is fixed inside the inner ring 19, so that a second heating chamber (cavity portion) 36 and a second drain discharge chamber (drain discharge portion) 37 are partitioned.

In the outer ring 18, the first heating chamber 33 is provided with a steam outer ring inlet portion 41, and is also provided with a steam outer ring outlet portion 42 so as to be separated from the steam outer ring inlet portion 41 in the circumferential direction. In the present embodiment, the steam outer ring inlet portion 41 and the steam outer ring outlet portion 42 are provided in the outer ring 18 so as to be separated by approximately 90 degrees, so that four steam outer ring inlet portions 41 and four steam outer ring outlet portions 42 are provided. Then, in the first heating chamber 33 of the outer ring 18, the steam outer ring inlet portion 41 and the steam outer ring outlet portion 42 communicate with each other by a first steam passage 43.

A plurality of (two in the present embodiment) the first steam passages 43 is arranged along an inner circumferential side in the first heating chamber 33 of the outer ring 18, and the first steam passages 43 are arranged in contact with an inner circumferential surface on a steam passage 21 side.

To be specific, as illustrated in FIGS. 3 and 4, the steam outer ring inlet portion 41 is formed as an outer ring inlet header 46 that is formed such that a part of the first heating chamber 33 is partitioned by a pair of inlet partition plates 44 and 45. Then, the steam outer ring inlet portion 41 is provided with a steam supply port 47 that penetrates the outer ring 18 from an outer circumferential side and communicates with the outer ring inlet header 46, and is provided with a steam supply port 48 that penetrates the inner circumferential side from the steam supply port 47. Then, the first steam passages 43 are arranged along the inside of a recess portion 33*a* formed in the inner circumferential side of the first heating chamber 33, and end portions of the first steam passages 43 penetrate a central portion of the inlet partition plate 45 and are fixed. Note that the plurality of first steam passages 43 is fixed to the inner circumferential side of the first heating chamber 33 with fixing metal fittings 49 at predetermined intervals.

Further, although not illustrated, the steam outer ring outlet portion 42 has a configuration similar to that of the steam outer ring inlet portion 41. The steam outer ring outlet portion 42 is formed as an outer ring outlet header formed such that a part of the first heating chamber 33 is partitioned by a pair of outlet partition plates, and is provided with a steam discharge port 50 (see FIG. 2) that penetrates the outer ring 18 from an outside and communicates with the outer ring outlet header. Then, the first steam passages 43 are arranged along the inner circumferential side of the first heating chamber 33, and end portions of the first steam passages 43 penetrate a central portion of the outlet partition plate and are fixed.

The first steam passage 43 is formed by a tube, as illustrated in FIG. 7. That is, the first steam passage 43 is composed of a tube main body 43*a* provided along a central portion, and a plurality of pleated portions 43*b* in outer circumferential portions of the tube main body 43*a*, each of the pleated portions 43*b* forming a ring shape. The plurality of pleated portions 43*b* is provided at predetermined intervals in a longitudinal direction of the tube main body 43*a*, and insides thereof communicate with each other.

Further, as illustrated in FIGS. 1 and 2, the inner ring 19 is provided with a steam inner ring inlet portion 51 in a second heating chamber 36, and is provided with a steam inner ring outlet portion 52 so as to be separated from the steam inner ring inlet portion 51 in the circumferential direction. In the present embodiment, the steam inner ring inlet portion 51 and the steam inner ring outlet portion 52 are provided in the inner ring 19 so as to be separated from each other by approximately 90 degrees, so that four steam inner ring inlet portions 51 and four steam inner ring outlet portions 52 are provided. Then, the steam inner ring inlet portion 51 is arranged to face the steam outer ring inlet portion 41 in a radial direction of the outer ring 18 and the inner ring 19, and the steam inner ring outlet portion 52 is arranged to face the steam outer ring outlet portion 42 in the radial direction of the outer ring 18 and the inner ring 19. Then, the steam inner ring inlet portion 51 and the steam inner ring outlet portion 52 communicate with each other by a second steam passage 53, in the second heating chamber 36 of the inner ring 19.

A plurality of (three in the present embodiment) the second steam passages 53 is arranged along an outer circumferential side in the second heating chamber 36 of the inner ring 19, and the second steam passages 53 are arranged in contact with an outer circumferential surface on a side of the steam passage 21.

To be specific, as illustrated in FIGS. 5 and 6, the steam inner ring inlet portion 51 is formed as an inner ring inlet header 56 formed such that a part of the second heating chamber 36 is partitioned by a pair of inlet partition plates 54 and 55, and is provided with a steam supply port 57 that penetrates the inner ring 19 from a vane 20 side and communicates with the inner ring inlet header 56. The second steam passages 53 are arranged along the inside of a recess portion 36*a* formed in the outer circumferential side of the second heating chamber 36, and end portions of the second steam passages 53 penetrate a central portion of the inlet partition plate 55 and are fixed. Note that the plurality of second steam passages 53 is fixed on the outer circumferential side of the second heating chamber 36 with fixing metal fittings 59 at predetermined intervals.

Further, although not illustrated, the steam inner ring outlet portion 52 has a configuration similar to that of the steam inner ring inlet portion 51. The steam inner ring outlet portion 52 is formed as an inner ring outlet header formed such that a part of the second heating chamber 36 is partitioned by a pair of outlet partition plates, and is provided with a steam discharge port that penetrates the inner ring 19 from the vane 20 side and communicates with the inner ring outlet header. Then, the second steam passages 53 are arranged along the outer circumferential side of the second heating chamber 36, and end portions of the second steam passages 53 penetrate a central portion of the outlet partition plate and are fixed.

Note that the second steam passage 53 is formed by a tube, similarly to the first steam passage 43, and is composed of a tube main body provided along a central portion, and a plurality of pleated portions in outer circumferential portions of the tube main body, each of the pleated portions forming a ring shape.

As illustrated in FIG. 2, the plurality of vanes 20 has a similar configuration, and hollow portions 61 are formed inside the vanes 20. Predetermined hollow portions 61 in the plurality of vanes 20 function as inlet communication passages 61*a* that make the steam outer ring inlet portions 41 and the steam inner ring inlet portions 51 communicate with each other. Further, predetermined hollow portions 61 in the plurality of vanes 20 function as outlet communication passages 61*b* that make the steam outer ring outlet portions 42 and the steam inner ring outlet portions 52 communicate with each other.

Note that, as illustrated in FIG. 1, in the outer ring 18, the first heating chamber 33 and the first drain discharge chamber 34 are partitioned by the partition wall 32, and the first drain discharge chamber 34 communicates with the hollow portions 61 of the vanes 20 and a drain discharge passage 71 communicates with the first drain discharge chamber 34. Further, in the inner ring 19, the second heating chamber 36 and the second drain discharge chamber 37 are partitioned by the partition wall 35, and the second drain discharge chamber 37 communicates with the hollow portions 61 of the vanes 20 and a drain discharge passage (not illustrated) communicates with the second drain discharge chamber 37. Drain entering through slits (not illustrated) provided in the vanes 20 is accumulated in the first drain discharge chamber 34 and the second drain discharge chamber 37. Then, the accumulated drain is discharged through the drain discharge passages.

Steam bled from a boiler or the steam turbine is supplied through the steam supply ports 47 in the outer ring 18 to the steam outer ring inlet portions 41. The steam supplied to the steam outer ring inlet portions 41 passes through the plurality of first steam passages 43 in the first heating chamber 33 of the outer ring 18 and flows into the steam outer ring outlet portions 42, and is discharged through the steam discharge ports 50 of the steam outer ring outlet portions 42 to an outside. Therefore, as illustrated in FIG. 1, since the steam passes through the first steam passages 43 along the inner circumferential side in the first heating chamber 33 of the outer ring 18, the inner circumferential side of the outer ring 18 is heated by the steam through the first heating chamber 33 (first steam passages 43), and the outer ring-side end portions of the vanes 20 are heated.

Further, as illustrated in FIG. 2, the steam supplied to the steam outer ring inlet portions 41 passes through the inlet communication passages 61*a* of the opposite vanes 20 and is supplied to the steam inner ring inlet portions 51 in the inner ring 19. The steam supplied to the steam inner ring inlet portions 51 passes through the plurality of second steam passages 53 in the second heating chamber 36 of the inner ring 19, and flows into the steam inner ring outlet portions 52. Then, the steam in the steam inner ring outlet portions 52 passes through the outlet communication passages 61*b* of the opposite vanes 20, flows into the steam outer ring outlet portions 42 in the outer ring 18, and is discharged through the steam discharge ports 50 of the steam outer ring outlet portions 42 to the outside. Therefore, as illustrated in FIG. 1, since the steam passes through the second steam passages 53 along the outer circumferential side in the second heating chamber 36 of the inner ring 19, the outer circumferential side of the inner ring 13 is heated by the steam through the second heating chamber 36 (second steam passages 53), and the outer ring-side end portions of the vanes 20 are heated.

The steam flowing in the steam passage 21 becomes wet steam when arriving at the vanes 20 of the final stage, and the drain contained in the wet steam collides with and adheres to the outer ring 18 and the inner ring 19 in the vanes 20 of the final stage. Especially, much of the drain adheres to the outer ring-side end portions and the inner ring-side end portions of the vanes 20. At this time, the outer ring 18, the inner ring 19, and the outer ring-side end portions and the inner ring-side end portions of the vanes 20 are heated by the steam that passes through the steam passages 43 and 53. Therefore, the adhering drain evaporates and becomes steam again. The drain scattering from the vanes 20 stops colliding with the blades 16, and erosion in the blades 16 is suppressed.

As described above, in the vane unit of the present embodiment, in the vane unit 17 in which the outer ring 18 and the inner ring 19 are connected by the plurality of vanes 20 arranged at predetermined intervals in the circumferential direction, the steam outer ring inlet portions 41 provided in the first heating chamber 33 of the outer ring 18, the steam outer ring outlet portions 42 provided in the first heating chamber 33 of the outer ring 18 so as to be separated from the steam outer ring inlet portions 41 in the circumferential direction, and the first steam passages 43 that make the steam outer ring inlet portions 41 and the steam outer ring outlet portions 42 to communicate with each other in the first heating chamber 33 of the outer ring 18 are provided.

Therefore, the steam supplied to the steam outer ring inlet portions 41 passes through the first steam passages 43 in the first heating chamber 33 of the outer ring 18, and is discharged through the steam outer ring outlet portions 42. Therefore, the outer ring 18 can be heated by the steam, and the outer ring-side end portions of the vanes 20 can be heated. Therefore, even if the drain contained in the wet steam flowing in the steam passage 21 adheres to the outer ring 18 and the outer ring-side end portions of the vanes 20 of the final stage, the outer ring 18 and the outer ring-side end portions of the vanes 20 have been heated and reached high temperature. Therefore, the adhering drain evaporates and becomes steam, and erosion in the blades 16 of a subsequent stage is suppressed. At this time, since the steam passes through the first steam passages 43, instead of the first heating chamber 33 of the outer ring 18, only necessary portions of the outer ring 18 and the vanes 20 are heated with a small amount of steam, and thus an amount of use of the steam is decreased and the small amount of steam is efficiently used, whereby the erosion due to the wet steam can be suppressed, and a decrease in thermal efficiency can foe suppressed.

In the vane unit of the present embodiment, the first steam passages 43 are arranged along the inner circumferential side in the first heating chamber 33 of the outer ring 18. Therefore, the inner circumferential side of the outer ring 18, that is, the outer ring-side end portions of the vanes 20 are heated by the steam. The portions, to which much of the drain contained in the steam flowing in the steam passage 21 is more likely to adhere, are heated. The outer ring 18 can be appropriately heated with a small amount of steam.

In the vane unit of the present embodiment, the first steam passage 43 is formed by a tube. Therefore, the first steam passages 43 can be easily arranged in the first heating chamber 33 of the outer ring 18, and the manufacturing cost can be decreased. Further, the first steam passage 43 is composed of the tube main body 43*a* provided along the central portion, and the plurality of pleated portions 43*b* in the outer circumferential portions of the tube main body 43*a*, each of the pleated portions 43*b* forming a ring shape. Therefore, by increasing a surface area of the first steam passage 43, the outer ring 18 can be efficiently heated.

In the vane unit of the present embodiment, the steam outer ring inlet portion 41 is configured as the outer ring inlet header 46 partitioned by the inlet partition plates 44 and 45, and the steam supply port 47 communicating with the outer ring inlet header 46 is provided in the outer ring 18. Further, the steam outer ring outlet portion 41 is configured as the outer ring outlet header partitioned by the pair of outlet partition plates, and the steam discharge port 50 communicating with the outer ring outlet header is provided in the outer ring 18. Therefore, the steam from an outside can be easily supplied to the steam outer ring inlet portion 41 and the steam can be easily discharged through the steam outer ring outlet portion 42. Further, the end portions of the first steam passages 43 can be easily connected to the steam outer ring inlet portion 41 and the steam outer ring outlet portion 42.

In the vane unit of the present embodiment, the first drain discharge chamber 34 is provided in the cavity portion of the outer ring 18 adjacent to the first heating chamber 33 (the outer ring inlet header 46 and the outer ring outlet header), and the first drain discharge chamber 34 communicates with the hollow portions 61 of the vanes 20. Therefore, the drain water generated in the hollow portions 61 of the vanes 20 can be easily discharged through the first drain discharge chamber 34 to an outside.

The vane unit of the present embodiment is provided with the steam inner ring inlet portions 51 provided in the second heating chamber 36 of the inner ring 19, the steam inner ring outlet portions 52 provided in the second heating chamber 36 so as to be separated from the steam inner ring inlet portions 51 in the circumferential direction, the inlet communication passages 61*a* provided in the vanes 20 and making the steam outer ring inlet portions 41 and the steam inner ring inlet portions 51 communicate with each other, the outlet communication passages 61*b* provided in the vanes 20 and making the steam outer ring outlet portions 42 and the steam inner ring outlet portions 52 communicate with each other, and the second steam passages 53 making the steam inner ring inlet portions 51 and the steam inner ring outlet portions 52 communicate with each other in the second heating chamber 36.

Therefore, the steam supplied to the steam outer ring inlet portions 41 flows through the inlet communication passages 61*a* to the steam inner ring inlet portions 51, passes through the second steam passages 53 in the second heating chamber 36 of the inner ring 19, flows into the steam inner ring outlet portions 52, and is discharged from the steam outer ring outlet portions 42 through the outlet communication passages 61*b*. Therefore, the inner ring 19 can be heated by the steam, and the inner ring-side end portions of the vanes 20 can be heated. Therefore, even if the drain contained in the wet steam flowing in the steam passage 21 adheres to the inner ring 19 of the final stage and the inner ring-side end portions of the vanes 20, the inner ring 19 and the inner ring-side end portions of the vanes 20 have been heated and reached high temperature. Therefore, the adhering drain evaporates and becomes steam, and the erosion in the blades 16 of a subsequent stage is suppressed. At this time, since the steam passes through the second steam passages 53, instead of the second heating chamber 36 of the inner ring 19, only necessary portions of the inner ring 19 and the vanes 20 are heated with a small amount of steam, and thus an amount of use of the steam is decreased and the small amount of steam is efficiently used, whereby the erosion due to the wet steam can be suppressed, and a decrease in thermal efficiency can be suppressed.

In the vane unit of the present embodiment, the second steam passages 53 are arranged along the outer circumferential side in the second heating chamber 36 of the inner ring 19. Therefore, the outer circumferential side of the inner ring 19, that is, the inner ring-side end portions of the vanes 20 are heated by the steam. The portions, to which much of the drain contained in the steam flowing in the steam passage 21 is more likely to adhere, are heated. The outer ring 18 can be appropriately heated with a small amount of steam.

In the vane unit of the present embodiment, the second steam passage 53 is formed by a tube. Therefore, the second steam passages 53 can be easily arranged in the second heating chamber 36 of the inner ring 19, and the manufacturing cost can be decreased. Further, the second steam passage 53 is composed of the tube main body provided along the central portion, and the plurality of pleated portions in the outer circumferential portions of the tube main body, each of the pleated portions forming a ring shape. Therefore, by increasing a surface area of the second steam passage 53, the inner ring 19 can be efficiently heated.

Further, the steam turbine of the present embodiment is provided with the casing 11, the rotor 12 rotatably supported in the casing 11, the plurality of stages of the blade units 14 each having the plurality of blades 16 arranged at predetermined intervals in the circumferential direction of the rotor 12, with base end portions of the blades supported by the rotor 12, and the plurality of stages of the vane units 17 each having the plurality of vanes 20 arranged at predetermined intervals in the circumferential direction of the rotor 12, with base end portions and tip end portions of the vanes supported by the casing 11, and the above-described vane unit is applied as the vane unit 17 of the final stage of the plurality of stages of the vane units 17.

Therefore, the outer ring 18, the inner ring 19, and the outer ring-side end portions and the inner ring-side end portions of the vanes 20 are heated by the steam. Therefore, even if the drain contained in the wet steam flowing in the steam passage 21 adheres to the outer ring 18, the inner ring 19, and the outer ring-side end portions and the inner ring-side end portions of the vanes 20 of the final stage, the adhering drain evaporates and becomes steam, and the erosion in the blades 16 of a subsequent stage is suppressed. At this time, since the steam passes through the first steam passages 43, instead of the first heating chamber 33 of the outer ring 18, only necessary portions of the outer ring 13, the inner ring 19, and the vanes 20 are heated with a small amount of steam, and thus an amount of use of the steam is decreased and the small amount of steam is efficiently used, whereby the erosion due to the wet steam can be suppressed, and a decrease in thermal efficiency can be suppressed.

Note that, in the above-described embodiment, four sets of the steam outer ring inlet portions 41 and the steam outer ring outlet portions 42 and four sets of the steam inner ring inlet portions 51 and the steam inner ring outlet portions 52 are provided, and the steam is brought to flow in a part (eight) of the vanes 20. However, the embodiment is not limited to this configuration. For example, two sets of the steam outer ring inlet portions 41 and the steam outer ring outlet portions 42 and two sets of the steam inner ring inlet portions 51 and the steam inner ring outlet portions 52 may be provided, and the steam may be brought to flow in four vanes 20, or eight sets of the steam outer ring inlet portions 41 and the steam outer ring outlet portions 42 and eight sets of the steam inner ring inlet portions 51 and the steam inner ring outlet portions 52 may be provided, and the steam may be brought to flow in sixteen vanes 20. Further, the steam may be brought to flow in all of the vanes 20.

Further, in the above-described embodiment, the steam passages 43 and 53 arranged in the heating chambers 33 and 36 are tubes. However, the embodiment is not limited to this configuration. For example, the steam passages may be formed by covering the recess portions 33*a* and 36*a* formed in the heating chambers 33 and 36 with plate members, or the steam passages may be formed by dividing a part of spaces in the heating chambers 33 and 36. Further, the plurality of steam passages 43 and 53 are provided as tubes. However, the numbers thereof are not limited to the particular numbers.

Further, in the above-described embodiment, the outer ring inlet header 46 and the outer ring outlet header, and the inner ring inlet header 56 and the inner ring outlet header are provided as the steam outer ring inlet portion 41 and the steam outer ring outlet portion 42, and the steam inner ring inlet, portion 51 and the steam inner ring outlet portion 52. However, the tubes as the steam passages 43 and 53 may be extended to an outside of the outer ring 18.

Further, in the above-described embodiment, the vane unit of the present invention has been applied to the vane unit of the final stage of the steam turbine. However, the vane unit of the present invention may be applied to other vane units.

REFERENCE SIGNS LIST

11 CASING
12 ROTOR
13 BEARING
14 BLADE UNIT
15 ROTOR DISK
16 BLADE
17 VANE UNIT
18 OUTER RING
19 INNER RING
20 VANE
21 STEAM PASSAGE
33 FIRST HEATING CHAMBER (CAVITY PORTION)
34 FIRST DRAIN DISCHARGE CHAMBER (DRAIN DISCHARGE PORTION)
36 SECOND HEATING CHAMBER (CAVITY PORTION)
37 SECOND DRAIN DISCHARGE CHAMBER (DRAIN DISCHARGE PORTION)
41 STEAM OUTER RING INLET PORTION
42 STEAM OUTER RING OUTLET PORTION
43 FIRST STEAM PASSAGE
44 and 45 INLET PARTITION PLATE
46 OUTER RING INLET HEADER
47 STEAM SUPPLY PORT
48 STEAM SUPPLY PORT
49 FIXING METAL FITTING
50 STEAM DISCHARGE PORT
51 STEAM INNER RING INLET PORTION
52 STEAM INNER RING OUTLET PORTION
53 SECOND STEAM PASSAGE
54 and 55 INLET PARTITION PLATE
56 INNER RING INLET HEADER
57 STEAM SUPPLY PORT
59 FIXING METAL FITTING
61 HOLLOW PORTION
61*a* INLET COMMUNICATION PASSAGE
61*b* OUTLET COMMUNICATION PASSAGE
71 DRAIN DISCHARGE PASSAGE

The invention claimed is:

1. A vane unit in which an outer ring and an inner ring are connected by a plurality of vanes arranged at predetermined intervals in a circumferential direction, the vane unit comprising:

a steam outer ring inlet portion provided in a cavity portion of the outer ring;

a steam outer ring outlet portion provided in the cavity portion of the outer ring so as to be separated from the steam outer ring inlet portion in the circumferential direction; and a first steam passage making the steam outer ring inlet portion and the steam outer ring outlet portion communicate with each other in the cavity portion of the outer ring, wherein the first steam passage is arranged along an inner circumferential side in the cavity portion of the outer ring.

2. The vane unit according to claim 1, wherein the first steam passage is formed by a tube.

3. The vane unit according to claim 1, wherein the steam outer ring inlet portion includes an outer ring inlet header formed by partitioning a part of the cavity portion by a pair of inlet partition plates, and a steam supply port provided in the outer ring and communicating with the outer ring inlet header, and the steam outer ring outlet portion includes an outer ring outlet header formed by partitioning a part of the cavity portion by a pair of outlet partition plates, and a steam discharge port provided in the outer ring and communicating with the outer ring outlet header.

4. The vane unit according to claim 3, wherein drain discharge portions are provided adjacent to the outer ring inlet header and the outer ring outlet header in the cavity portion of the outer ring, and the drain discharge portions communicate with hollow portions of the vanes.

5. The vane unit according to claim 1, further comprising:

a steam inner ring inlet portion provided in a cavity portion of the inner ring;

a steam inner ring outlet portion provided in the cavity portion of the inner ring so as to be separated from the steam inner ring inlet portion in the circumferential direction;

an inlet communication passage provided in the vane and making the steam outer ring inlet portion and the steam inner ring inlet portion communicate with each other;

an outlet communication passage provided in the vane and making the steam outer ring outlet portion and the steam inner ring outlet portion communicate with each other; and a second steam passage making the steam inner ring inlet portion and the steam inner ring outlet portion communicate with each other in the cavity portion of the inner ring.

6. The vane unit according to claim 5, wherein the second steam passage is disposed along an outer circumferential side in the cavity portion of the inner ring.

7. The vane unit according to claim 5, wherein the second steam passage is formed by a tube.

8. A steam turbine comprising:

a casing;

a rotor rotatably supported inside the casing;

a plurality of stages of blade units each having a plurality of blades arranged at predetermined intervals in a circumferential direction of the rotor, with base end portions of the blades supported by the rotor; and a plurality of stages of vane units each having a plurality of vanes arranged at predetermined intervals in the circumferential direction of the rotor, with base end portions and tip end portions of the vanes supported by the casing, wherein the vane unit according to claim 1 is applied as the vane unit of a final stage of the plurality of stages of the vane units.

9. The vane unit according to claim 2, wherein the tube is formed in a bellows shape.

10. The vane unit according to claim 7, wherein the tube is formed in a bellows shape.

11. The vane unit according to claim 1, wherein the first steam passage is formed by using a part of the cavity portion.

12. The vane unit according to claim 6, wherein the second steam passage is formed by using a part of the cavity portion.

* * * * *